US006400076B1

(12) United States Patent
Allen et al.

(10) Patent No.: US 6,400,076 B1
(45) Date of Patent: Jun. 4, 2002

(54) XENON METAL HALIDE LAMP HAVING IMPROVED THERMAL GRADIENT CHARACTERISTICS FOR LONGER LAMP LIFE

(75) Inventors: Gary R. Allen, Chesterland; Rocco T. Giordano, Garfield Heights; Gary O. Jacobs, Willoughby; Kenneth S. King, Chesterland; Timothy P. Dever, Fairview Park, all of OH (US)

(73) Assignee: General Electric Company, Schenectady, NY (US)

( * ) Notice: Subject to any disclaimer, the term of this patent is extended or adjusted under 35 U.S.C. 154(b) by 866 days.

(21) Appl. No.: 08/649,887

(22) Filed: May 14, 1996

(51) Int. Cl.[7] ..... H01J 17/04; H01J 61/02
(52) U.S. Cl. ..... 313/572; 313/620; 313/634
(58) Field of Search ..... 313/570, 571, 313/572, 573, 620, 639, 110, 112, 113, 635, 634; 359/359, 389

(56) References Cited

U.S. PATENT DOCUMENTS

| | | | | |
|---|---|---|---|---|
| 4,594,529 A | * | 6/1986 | De Vrijer | 313/571 |
| 5,047,695 A | * | 9/1991 | Allen et al. | 315/291 |
| 5,204,578 A | * | 4/1993 | Dever et al. | 313/25 |
| 5,239,230 A | * | 8/1993 | Mathews et al. | 313/571 |
| 5,552,671 A | * | 9/1996 | Parham et al. | 313/635 |

FOREIGN PATENT DOCUMENTS

| | | |
|---|---|---|
| EP | 0 483 507 A | 9/1991 |
| EP | 0 571 813 A | 5/1993 |
| EP | 0 727 813 A | 8/1996 |

* cited by examiner

*Primary Examiner*—Jay Patidar
(74) *Attorney, Agent, or Firm*—Fay, Sharpe, Fagan, Minnich & McKee, LLP

(57) ABSTRACT

A high brightness discharge light source having improved thermal balance characteristics includes a lamp envelope having an arc chamber formed therein and a pair of electrodes extending into opposite ends of the arc chamber so as to be displaced from one another by a distance of no greater than 4 mm. A fill disposed within the arc chamber is excited to a discharge state upon the introduction of an excitation energy coupled through the pair of electrodes. The light source is operated vertically so that one of the electrodes is disposed at the top region and the other electrode is disposed at the bottom region of the arc chamber. The arc chamber is formed having a diameter dimension which is just larger than the spacing between the electrodes, and a height dimension which is approximately twice the diameter dimension. The diameter dimension is substantially uniform along the length of the arc chamber. The uniform diameter characteristic is effective so that the thermal operating properties associated with the discharge state are substantially equally distributed from the top to the bottom regions of the arc chamber thereby resulting in extending the life of this light source to approximately 6000 hours.

8 Claims, 2 Drawing Sheets

10

XENON METAL HALIDE LAMP HAVING IMPROVED THERMAL GRADIENT CHARACTERISTICS FOR LONGER LAMP LIFE

FIELD OF THE INVENTION

This invention relates to a xenon-metal halide lamp having improved thermal balance characteristics associated therewith. More particularly, this invention relates to such a xenon-metal halide lamp as exhibits a specific lamp envelope shape that insures a balanced thermal distribution within the discharge chamber so as to result in a lamp capable of extended life and higher brightness.

BACKGROUND OF THE INVENTION

Xenon metal halide lamps have been finding greater and greater use in the lighting field recently, particularly in the automotive lighting field or any other field where a high brightness light source with instant-on capabilities is required. One example of such a high brightness light source can be found in U.S. Pat. No. 5,239,230 by Mathews et al and assigned to the same assignee as the present invention and which is herein incorporated by reference. In this patent, a high brightness light source is disclosed having specific performance characteristics such as wall-loading, tensile strength of the lamp envelope material, convective stability and lamp operating voltage and mercury density; such characteristics being cooperatively balanced so as to achieve such high brightness with an arc discharge gap which is on the order of 4 millimeters or less in length, and operating at a fill density >50 mg/cc (>50 atmospheres). A central lighting system utilizing this high brightness light source is included in the commercial product offered by General Electric Company's Lighting Business as the Light Engine® centralized lighting system.

Such a centralized lighting system offers many advantages to lighting designers including the obvious advantage of requiring less space for light fixture or delivery devices; that is, equipment or devices that are needed for mounting and reflecting, refracting or otherwise delivering the light output in the desired pattern. In an automotive application for instance, it is a great advantage to disposing the light source away from the front end of the vehicle so as to allow more freedom in aerodynamic body styling of such vehicles. Having achieved success in designing a high brightness light source that can be disposed in one location and have the light output efficiently transmitted to one or more remote locations, the lamp designer still has other challenges to optimizing the design of such a high brightness light source. For instance, it would be desirable to provide the above described light source in a configuration that achieved a longer life expectancy than is presently achievable in spite of the extremely high operating pressure of the fill gas that is necessary to provide both high brightness and instant light. For instance, it is known that because of the pressure and temperatures at which the above-described light source operates, it has been found that this light source has a life expectancy of approximately 2000–4000 hours whereas it would be desirable that such a lamp exhibit a life expectancy on the order of about 2–3 times such a level.

In discovering a means for extending the life of such a high brightness light source, it was first necessary to understand the mechanism by which the end of life lamp failure occurred. Through empirical measurements taken using the above-described commercially available Light Engine light source, it was determined that for a xenon-metal halide lamp operated in a vertical orientation and powered by a DC source, a strong convection cell is generated inside the arc chamber of the lamp thereby causing a higher temperature at the cathode (upper) end than at the anode (lower) end and limiting lamp life thereby. Accordingly, it was determined that in order to extend lamp life to the desired level of approximately 6000 hours, it was necessary to find some way to limit the temperature gradient between the anode end and the cathode end of a DC powered, vertically oriented high brightness light source.

One known way for limiting temperature rises in a lamp is by use of a heat sink device. One such heat sink arrangement for a metal halide light source can be found in U.S. Pat. No. 5,204,578 issued to Dever et al on Apr. 20, 1993 and assigned to the same assignee as the present invention. In this patent, it is disclosed that a metal strip or cylindrically shaped metal piece can be disposed in contact with the outer surface of the arc tube chamber so as to draw heat thereto and away from the ends of the arc tube at which the electrodes are disposed. Though effective in operation with a light source that can be mounted individually within a headlamp assembly for instance, such a heat sink arrangement for a centralized light source which must couple light as efficiently as possible to remote locations, is not practical because of the amount of light that is blocked by the externally disposed metal pieces. Accordingly, it would be advantageous if a means for substantially reducing the thermal gradient between the anode and cathode elements of a DC operated, vertically oriented high brightness centralized light source could be developed that did not block light output.

It is also known that for the thermal operating characteristics of a light source with an elongated vertical arc tube, the convective heat load at the upper end of said elongated vertical arc tube is proportional to the arc tube radius to the fourth power. This relationship is discussed by D. M. Cap in the paper "Grashof Numbers and Swirling Arcs", Advanced Engineering #931, published Sep. 2, 1970. Though providing guidance relative to the property of convection velocity and thus heat loading, such an approach is not sufficient to attain a high brightness, short-arc discharge light source such as provided by the above-referenced Light Engine lighting system. For such a light source, one must consider maintaining the design features necessary to achieve the high brightness characteristics. From the above-referenced Mathews patent for the Light Engine light source, it is known that to achieve the desired level of brightness, certain design parameters must be simultaneously satisfied. For instance, to achieve a brightness level in excess of 50,000 lumens per square centimeter of arc gap unit area, the mercury density must be within a specific range of values, the arc gap must be less than approximately 4 millimeters, and the wall loading must be less than 25 watts per centimeter squared of arc tube surface area, and preferentially approximately 20 watts per centimeter with a tensile strength of a certain value to ensure the integrity of the arc tube. In order to meet these and other design requirements, a number of parameters must be balanced so that optimizing one or some of the parameters does not result in destabilizing the lamp or reducing the brightness output. Accordingly, it would be advantageous to design a high brightness light source with a unique envelope structure that would result in improved thermal operating properties for the light source without risking a loss in the amount of light output otherwise attainable.

One example of a light source having a non-ellipsoidally shaped arc chamber can be found in U.S. Pat. No. 4,594,529 issued to de Vrijer on Jun. 10, 1986. This patent discloses an elongated arc chamber but does not address the problems associated with lamp life related to heat load properties; the elongated arc is provided for the purpose of achieving a long arc discharge which is horizontally oriented and is utilized as a single direct source of light rather than a high brightness light source which is centrally located and remotely distributed.

Another problem associated with the operation of the high brightness light source at high pressure such that a significant thermal gradient exists between the cathode end (top) and the anode end (bottom) of the arc chamber was that, because of the higher operating temperatures at the top region, a pool of metal halide could not exist therein; the only metal halide pool available for use in the arc discharge came from the bottom region. Therefore, it would be advantageous if a high brightness light source could be developed that provided thermal operating conditions that allowed for the temperature at the inside top surface of the vertically disposed arc chamber to be comparable to the temperature at the inside of the arc chamber thereby allowing a larger area at which the metal halide pool could reside.

SUMMARY OF THE INVENTION

The present invention provides a high brightness, short arc gap light source having an extended life characteristic relative to other high intensity discharge lamps operating at high pressures and having high brightness light output capabilities. The inner dimensions of the lamp envelope are shaped so as to interrelate with one another and result in a reduction in the vertical temperature gradient along the inside surface of the arc chamber.

In accordance with the principles of the present invention, there is provided a high brightness light source comprising a lamp envelope having an arc chamber formed therein as well as a pair of electrode members which extend into the arc chamber and have a preselected spacing provided therebetween. Energizing means are connected to the electrode members so as to power the light source and result in the generation of an arc discharge within the arc chamber, the arc discharge having associated therewith, certain thermal operating properties. The light source is operated in a vertical orientation such that one of the electrodes, the cathode in the case of a DC operated light source, is disposed at the top region of the arc chamber. The arc chamber is constructed so that the inner diameter thereof is sufficiently small to control the overheating of the top of the arc chamber by limiting convective flow and is essentially uniform in dimension from top to bottom. By such shape and dimensional relationship, the thermal operating properties of this lamp are such that substantially equal operating temperatures are achieved at the inside top and inside bottom surfaces of the arc chamber in spite of the extremely high operating pressure of the fill gases. Moreover, by such an arc chamber configuration, the light source of the present invention operates such that the operating temperatures are even lower at the top region of the arc chamber than at the lower regions, allowing for additional wall coverage of the molten metal-halides at the top inside surface of the arc chamber. The highest inside surface temperatures are located at the same height as the arc gap, so that the quartz surface in that region remains clear of metal-halides, allowing maximum collection of the light emitted from the arc by the optical collection system of the light source.

BRIEF DESCRIPTION OF THE DRAWINGS

In the following detailed description, reference will be made to the attached drawings in which.

DETAILED DESCRIPTION AND OPERATION

Figure 1:
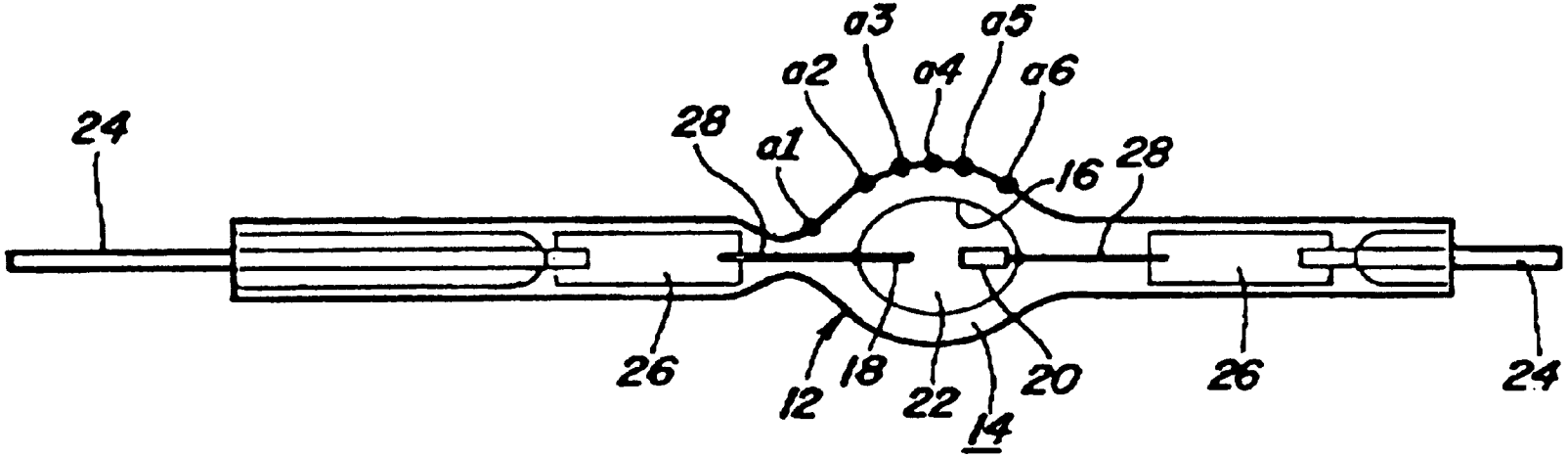
PRIOR ART Fig. 1
FIG. 1 is an elevational view in section of a high brightness light source constructed in accordance with the teachings of the prior art (U.S. Pat. 5,239,230) and having indicated thereon, typical thermal operating properties of such prior art light source.

As seen in FIG. 1, the high brightness light source 10 of the prior art includes a double ended lamp envelope 12 which is constructed of a light transmissive material capable of operating under high temperature conditions, typically quartz. The lamp envelope 12 is constructed having a center, bulbous portion 14 in which is formed an arc chamber 16. Extending into arc chamber 16 are first and second electrodes 18, 20 wherein the first electrode 18 is shown as being smaller than the second electrode 20. This is typically the situation where the light source is energized from a DC power source (not shown). In such a configuration, the first electrode 18 is a cathode electrode and the second electrode 20 is an anode electrode and when operated in a vertical orientation, the first electrode 18 is above the second electrode 20. In the application of the light source within the Light Engine centralized lighting system, the light source 10 is disposed in a vertical orientation and is disposed within a reflector arrangement (not shown) for purposes of collecting light output and focussing such light output in a manner for efficient delivery to the desired remote locations. Connected to the respective first and second electrode members 18, 20 are lamp inlead assemblies which are effective for allowing connection of the power source (not shown) to the light source 10. Lamp inlead assemblies include outer lead wire members 24, inner lead wire members 28 and foil members 26 which are constructed of a thin foil of molybdenum and are effective so as to allow for a precise sealing operation of the lamp envelope 12 at the end regions thereof.

According to the prior art arrangement for achieving a high brightness light source in a short arc gap configuration, the arc chamber 16 formed within the lamp envelope 12 is ellipsoidally shaped. Contained within arc chamber 16 is a fill 22 which can include mercury, an inert gas, and metal halides. The heat loading exerted on the lamp envelope 12 resulting from the arc discharge and convection currents associated therewith are determined largely as a function of such arc chamber shape. As indicated in FIG. 1, there are several points along the exterior of the quartz lamp envelope 12 at which measurements are taken. These measurement points are listed below in Table 1 as reference points a1 through a6 and are average values taken from a representative sampling of 20 light sources 10 constructed according to the prior art.

TABLE 1

PRIOR ART OPERATING TEMPERATURES(° C.)

| | Outside Measured | Inside Modeled | Inside Ideal |
|---|---|---|---|
| Ref. a1 | 858 | 899 | <850 |
| Ref. a2 | 897 | 938 | 850–890 |
| Ref. a3 | 880 | 914 | <900 |
| Ref. a4 | 860 | 894 | <900 |
| Ref. a5 | 840 | 867 | 850–890 |
| Ref. a6 | 838 | 865 | 850–890 |

The temperatures labeled as Outside Measured were measured on the exterior surface of the quartz lamp envelope 12. The temperatures labeled as Inside Modeled are estimated temperatures at the inside surface of the quartz envelope 12, resulting from a Finite Element Model calculation. The temperature labeled as Inside Ideal represent the ideal temperatures at the inside surface of the quartz envelope 12 at which optimal photometric performance and long life can be expected. It is known that for optimal operation of high intensity discharge metal-halide lamps, the metal halide pool which will be located approximately near reference points as and a6, should run at approximately 850 to 890 C. The average temperature at reference points a5 and a6 can be defined as the cold spot temperature, here equal to 866° C. By contrast, the hottest temperature on the inside surface is 938° C. exceeding the desirable limit of 900° C. for long life. The difference between the hottest spot and the cold spot is 72° C. This is the degree of the thermal non-uniformity in the prior art and it is typical of standard metal-halide lamps of most types. In the improved light source 30, the degree of thermal non-uniformity is substantially reduced resulting in more optimal photometric lamp performance and longer life.

Figure 2:
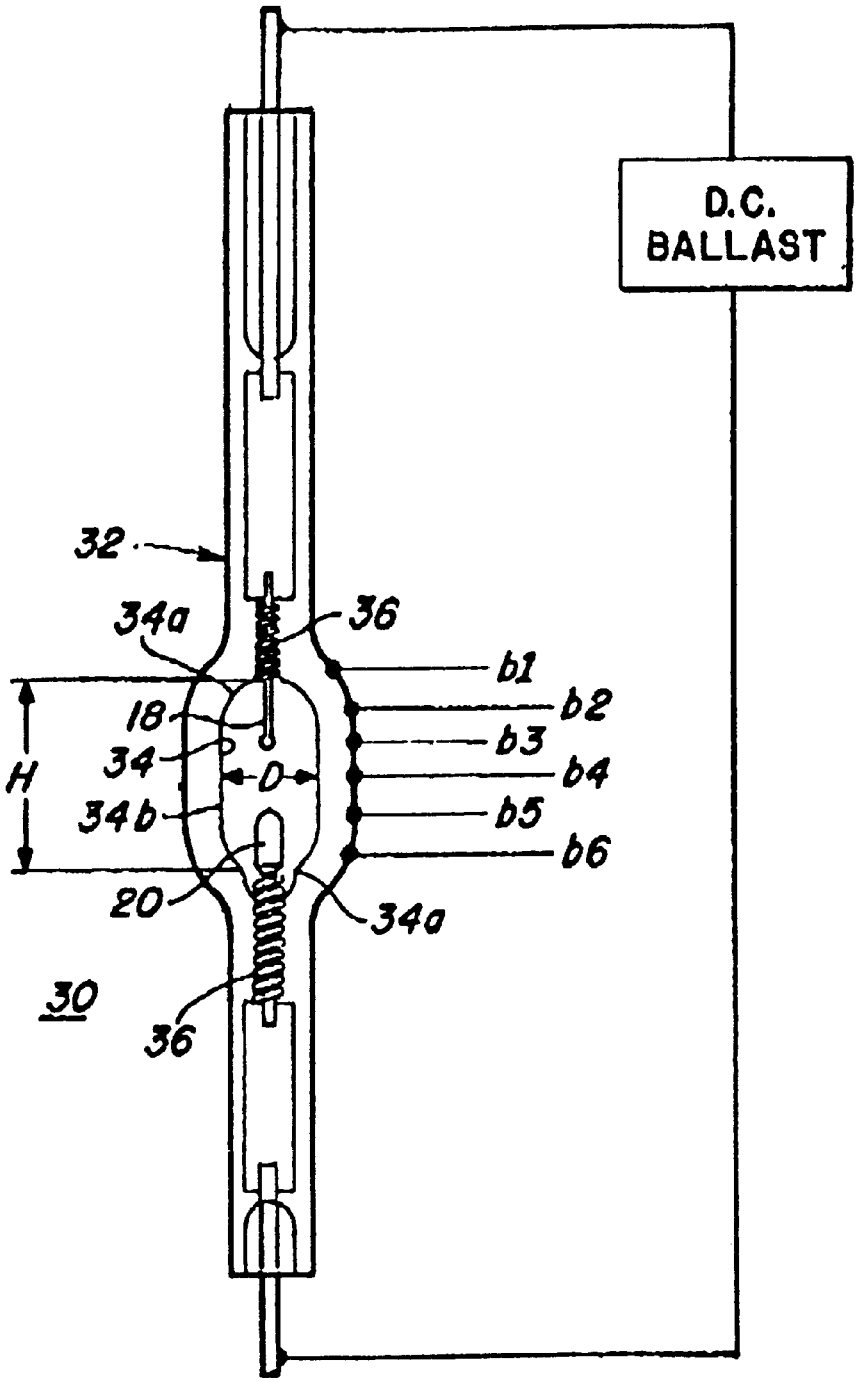
FIG. 2 is an elevational view in section of a high brightness light source constructed in accordance with the teachings of the present invention and having indicated thereon, typical thermal operating properties of this light source.

For the light source 30 as illustrated in FIG. 2, like numerals will refer to like elements as originally described with respect to FIG. 1 and new numerals will refer to new elements of the light source 30. The improved light source 30 of FIG. 2 having a lamp life on the order of approximately 6000 hours, includes a double ended lamp envelope 32 constructed of a light transmissive material such as quartz. Disposed within lamp envelope 32 is an elongated arc chamber 34 into which the first and second electrodes 18, 20 extend so as to be spaced apart by a distance of no more than 4 millimeters. Disposed around the respective inner lead wire portions 28 of the lamp inlead assemblies, are centering coils 36. The centering coils 36 are provided for the conventional purpose of insuring the integrity of the hermetic seals formed around the respective lamp inlead assemblies. Connected to the outer ends of the respective inlead assemblies is a conventional power source such as a DC ballast arrangement 40 shown in block diagram form and which can be provided for instance by the circuit shown in U.S. Pat. No. 5,047,695 issued to Allen et al on Sep. 10, 1991 and assigned to the same assignee as the present invention.

The elongated arc chamber 34 of FIG. 2 includes end chamber regions 34*a* and a central elongated region 34*b*. The arc gap 38 formed between the ends of the first and second electrodes 18, 20 resides substantially within the central elongated region 34*b* of the elongated arc chamber 34.

As seen in FIG. 2, there is a predetermined relationship between the height of arc chamber 34 (dimension H in FIG. 2) and the diameter (dimension D) which are selected so as to maintain a sufficient space to allow the arc discharge to reside between the first and second electrodes 18, 20 without contacting the side walls of the arc chamber 34. In the preferred embodiment of the light source 30, arc chamber 34 is constructed having a height dimension H of approximately 8 millimeters and a diameter dimension D of approximately 4 mm the arc gap is preferably between 2 and 3.5 mm, a gap of approximately 2.7 mm being particulary preferred. It should be understood that these dimensional values are representational and are not intended as a limitation to the scope of the present invention. Moreover, it is a further requirement of the present invention that the diameter of the arc chamber 34 be maintained at a substantially uniform value for at least as much as one-half of the height of the arc chamber 34 and that such uniform diameter occur at the center portion of the arc chamber 34 so as to substantially surround and extend above and below the end regions of the first and second electrode members 18, 20. It is a further requirement of the present invention that the wall of the quartz envelope be sufficiently thick (2.2 mm in the preferred embodiment) so that the surface area of the exterior of the quartz envelope is sufficiently large to sustain the transport of heat from the quartz to the ambient atmosphere to avoid overheating of the quartz. A standard design rule for low-wattage metal-halide lamps is to not exceed 20 W to 25 W of lamp operating power per $cm^2$ of exterior surface area of the quartz envelope.

The diameter dimension D is critical to limiting the convective flow of the hot fill gases inside the arc chamber 34 during lamp operation so as to reduce the convective heating at the top of the quartz envelope. The convected power transported to the top of the arc chamber is shown to be proportional to Gr·R in the previously referenced paper by D. M. Cap wherein Gr is the Grashof number and R is one-half the bore diameter. Whereas convective stability of the high-brightness, instant-light metal-halide was established in U.S. Pat. No. 5,239,230, by control of the lamp parameters resulting in $Gr/c<1400\ mg^2/cc$ (where c is the speed of light), it is disclosed in the present invention that an even stricter design constraint on the convected power results in an isothermal temperature distribution vertically along the inside surface of the arc chamber resulting in longer lamp life when a parameter proportional to the convected power, $Gr{\cdot}R/c$ is $<<200\ mg^2/cm^2$, and that this constraint is achievable even at the very high operating pressures required to achieve arc brightness>50,000 Lm per $cm^2$ of arc gap length.

The following Table 2 illustrates a comparison of characteristics of various types of low-wattage metal halide discharge lamps with shaped arc chambers including the high-brightness lamp of U.S. Pat. No. 5,239,230 (the LE60 lamp) and the high-brightness, long-life lamp of the present invention.

In the preferred embodiment, the lamp design of the present invention as represented in Table 3 also incorporates the UV-reflecting thin film of U.S. Pat. No. 5,552,671 by Parham et al, whereby the metal halide pool is heated directly by the attenuation of the near-UV power emitted from the arc into the metal halide pool. The preferential deposition of near-UV power directly into the metal halide pool further enhances the photometric performance of the lamp while also contributing further to the isothermal condition of the arc chamber.

TABLE 2

| Lamp | Power (Watts) | Lumens | Gap (cm) | Brightness Lumens/Gap$^2$ (Lumens/cm$^2$) | R (cm) | Fill Density (mg/cm$^2$) | Arc Stability Gr/C (mg$^2$/cm$^3$) | Convected Gr · R/C (mg$^2$/cm$^2$) |
|---|---|---|---|---|---|---|---|---|
| MXR150 | 150 | 12,400 | 1.50 | 5,511 | 0.54 | 8.62 | 114 | 61 |
| MXR100 | 100 | 9,000 | 1.50 | 4,000 | 0.48 | 10.91 | 130 | 62 |
| MXR70 | 70 | 5,500 | 1.05 | 4,989 | 0.35 | 10.25 | 43 | 15 |
| MXR32 | 32 | 2,500 | 0.58 | 7,431 | 0.29 | 27.43 | 181 | 52 |
| D1 | 35 | 3,200 | 0.40 | 20,000 | 0.15 | 64 | 136 | 20 |
| LE60 | 60 | 4,200 | 0.27 | 57,613 | 0.30 | 54 | 800 | 240 |
| Present Invention | 60 | 4,500 | 0.27 | 61,728 | 0.20 | 54 | 237 | 47 |

It is apparent that the convected power in the present invention is comparable to that of the standard low-brightness MXR lamps, so that long lamp life is expected even though the brightness exceeds that of the standard metal-halide lamps by approximately ten times.

By adherence to the above-defined spatial relationships, it has been found that the operating temperatures measured at the same positions along the exterior surface of the lamp envelope 32 are significantly more uniform, significantly lower at the cathode region (near the first electrode 18) of the arc chamber 34, and, eliminate the hot spot characteristic (see reference point a2) present in the prior art light source 10.

TABLE 3

| PRESENT INVENTION OPERATING TEMPERATURES(° C.) | | | |
|---|---|---|---|
| | Outside Measured | Inside Modeled | Inside Ideal |
| Ref. b1 | 763 | 823 | <850 |
| Ref. b2 | 786 | 846 | 850–890 |
| Ref. b3 | 819 | 869 | <900 |
| Ref. b4 | 829 | 879 | <900 |
| Ref. b5 | 823 | 863 | 850–890 |
| Ref. b6 | 828 | 868 | 850–890 |

As seen by the Measured Outside temperatures illustrated in Table 3, and Modeled Inside operating temperatures of the arc chamber, the light source 30 having the improved thermal operating characteristics of the present invention exhibits several key advantages over the prior art values shown in Table 1. For instance, the necessary operating temperature of approximately 870 to 890° C. for the halide pool region (see ref. point b5) is still met, but the hot spot temperature at ref. point a2 of Table 1 is substantially reduced to 879° C. at ref. point b4 of Table 3, such that the difference between the hot spot and cold spot temperatures at the anode end is only 14° C., so that the inside surface is substantially isothermal (<30° C. variations are substantially isothermal) in fact, the cathode end (top) of light source 30 actually runs cooler than the midpoint region. By such improved thermal operation wherein the temperature gradient between the top and bottom sections of the lamp envelope 12 is greatly reduced compared to that of the prior art light source 10 of FIG. 1, the light source 30 as shown in FIG. 2 has been tested to confirm a life of approximately 6000 hours.

Although the hereinabove described embodiment of the invention constitutes the preferred embodiment, it should be understood that modifications can be made thereto without departing from the scope of the invention as set forth in the appended claims.

What is claimed is:

1. A low wattage arc discharge light source exhibiting high brightness properties comprising:

an arc tube having an arc chamber formed therein;

said arc tube having an elongated portion;

a fill disposed in said arc chamber and energizible to a discharge condition, said fill including a dose of mercury;

at least two electrodes extending from generally opposite vertical directions into a region of said arc chamber, said region being surrounded by said elongated portion of said arc tube, said electrodes being separated by an arc gap of less than 4 mm and wherein, upon energization of said light source, an operating voltage is developed across said at least two electrodes resulting in an arc;

said arc chamber having a size dimension selected so that, in association with a selected fill density, results in a convection stability value less than 750 milligrams squared per cubic centimeter for improving thermal uniformity, and a convected power of less than 200 milligrams squared per squared centimeter;

said arc tube has arc tube dimension values including a wall thickness that are balanced to achieve a wall loading factor of no greater than 25 watts per centimeter squared of arc tube surface area; and, said light source achieves a brightness level in excess of 40,000 lumens per centimeter squared of arc gap unit area.

2. A low wattage arc discharge light source as set forth in claim 1 wherein the brightness level exceeds 50,000 lumens per centimeter squared of arc gap unit area.

3. A low wattage arc discharge light source as set forth in claim 2 wherein the brightness level exceeds 60,000 lumens per centimeter squared of arc gap unit area.

4. A low wattage arc discharge light source as set forth in claim 3 wherein the convection stability value is less than 300 milligrams squared per cubic centimeter, the convected power is less than 50 milligrams squared per cubic centimeter, and the wall loading factor is approximately 20 watts per centimeter squared of arc tube surface area.

5. A low wattage arc discharge light source as set forth in claim 4 further comprising a multi-layer coating deposited on the exterior surface of said arc tube, said coating comprising at least two different materials having different refractive indexes which, in combination, absorb deep UV radiation and reflect near UV radiation, the coating functioning to absorb the radiant energy emitted from the arc as deep UV radiation uniformly along the exterior of said arc tube in said multi-layer coating and reflecting the radiant energy emitted from the arc as near UV radiation back into said lamp, and wherein the multi-layer coating functions to reflect back into the arc tube the near UV radiation where it is substantially absorbed into the metal halide pool thereby heating the cold spot and enhancing the vapor pressure of the metal halide dose of said metal halide lamp.

6. A low wattage arc discharge light source as set forth in claim 1 wherein the convection stability value is less than 300 milligrams squared per cubic centimeter.

7. A low wattage arc discharge light source as set forth in claim 1 wherein the convected power is less than 50 milligrams squared per squared centimeter.

8. A low wattage arc discharge light source as set forth in claim 1 wherein the wall loading factor is approximately 20 watts per centimeter squared of arc tube surface area.

* * * * *